US006438343B1

(12) United States Patent
Inoue

(10) Patent No.: US 6,438,343 B1
(45) Date of Patent: Aug. 20, 2002

(54) IMAGE FORMING APPARATUS

(75) Inventor: Masahiro Inoue, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/500,456

(22) Filed: Feb. 9, 2000

(30) Foreign Application Priority Data

Feb. 12, 1999 (JP) ..... 11-035074
Jan. 31, 2000 (JP) ..... 2000-022822

(51) Int. Cl.[7] ..... G03G 15/01; G03G 15/02
(52) U.S. Cl. ..... 399/149; 399/174; 399/302
(58) Field of Search ..... 399/149, 150, 399/299, 302, 223, 101, 174, 175, 349

(56) References Cited

U.S. PATENT DOCUMENTS

| | | | | |
|---|---|---|---|---|
| 4,162,843 A | | 7/1979 | Inoue et al. | 399/179 |
| 5,091,751 A | | 2/1992 | Inoue et al. | 399/303 |
| 5,187,536 A | | 2/1993 | Hasegawa et al. | 399/300 |
| 5,339,149 A | * | 8/1994 | Lindblad et al. | 399/349 X |
| 5,455,663 A | | 10/1995 | Inoue et al. | 399/303 |
| 5,515,154 A | | 5/1996 | Hasegawa et al. | 399/303 |
| 5,563,695 A | | 10/1996 | Sakurai et al. | 399/327 |
| 5,594,538 A | | 1/1997 | Takekoshi et al. | 399/310 |
| 5,701,559 A | * | 12/1997 | Ootaka et al. | 399/149 |
| 5,740,493 A | * | 4/1998 | Otaki et al. | 399/299 X |
| 5,784,674 A | * | 7/1998 | Iseki et al. | 399/297 |
| 5,797,070 A | * | 8/1998 | Waki et al. | 399/149 |
| 5,835,821 A | * | 11/1998 | Suzuki et al. | 399/174 X |
| 5,970,285 A | * | 10/1999 | Ito et al. | 399/149 |
| 5,999,201 A | * | 12/1999 | Dalal et al. | 399/302 X |
| 6,006,055 A | * | 12/1999 | Furuya | 399/149 |
| 6,029,033 A | * | 2/2000 | Kawasaki | 399/149 |
| 6,137,976 A | * | 10/2000 | Itaya et al. | 399/302 X |
| 6,253,041 B1 | * | 6/2001 | Tomizawa et al. | 399/302 X |

FOREIGN PATENT DOCUMENTS

| | | |
|---|---|---|
| JP | 53-074037 | 7/1978 |
| JP | 59-133573 | 7/1984 |
| JP | 62-203182 | 9/1987 |
| JP | 63-133179 | 6/1988 |
| JP | 01-020587 | 1/1989 |
| JP | 02-051168 | 2/1990 |
| JP | 02-302777 | 12/1990 |
| JP | 05-002287 | 1/1993 |
| JP | 05-002289 | 1/1993 |
| JP | 05-053482 | 3/1993 |
| JP | 05-061383 | 3/1993 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a plurality of image bearing members, a plurality of developing devices for developing latent images formed on the plurality of image bearing members with toners of plural colors, an intermediate transfer member to which toner images of plural colors are successively transferred from the plurality of image bearing members, the toner images of plural colors on the intermediate transfer member being transferred to a recording material, and a plurality of chargers for charging residual toners residual on the image bearing members after the toner images have been transferred from the image bearing members to the intermediate transfer member, the residual toners on the image bearing members charged by the chargers being electrostatically collected into the developing devices.

16 Claims, 3 Drawing Sheets

IMAGE FORMING APPARATUS

BACKGROUND OF THE INVENTION

1. Field of the Invention

This invention relates to an image forming apparatus such as a copier, a printer or a facsimile apparatus, and particularly to an image forming apparatus having an intermediate transfer member.

2. Related Background Art

In recent years, image forming apparatuses such as electrophotographic apparatuses have been advanced toward compactness, higher function and coloration, and on the other hand, requirements for improved reliability, system evolution, freedom from maintenance and being tender to human beings and environments have heightened, and various propositions have been made in order to meet those requirements.

For example, Japanese Patent Laid-Open Application No. 53-74037 (corresponding U.S. Pat. No. 4,162,843) discloses an image forming apparatus in which for the higher speed of a color image output, a plurality of photosensitive members (image bearing members) are stacked and a plurality of toner images formed on the plurality of photosensitive members are successively transferred to a recording material while the recording material is conveyed by belt-shaped conveying means (transfer belt).

On the other hand, recently, image forming apparatuses called "cleaning simultaneous with developing" or "cleanerless" apparatuses in which particularly for the downsizing of the entire apparatus, the ecological countermeasure by the non-production of waste toner, the longer life of a photosensitive member and the curtailment of the amount of consumed toner per page, developing means is made to serve also as cleaning means for untransferred toner residual on the surface of the photosensitive member after the transfer of a toner image to a recording material, whereby the provision of cleaning means exclusively for the cleaning purpose is eliminated have also made advent (Japanese Patent Laid-Open Application Nos. 59-133573, 62-203182, 63-133179, 64-20587, 2-51168, 2-302772, 5-2287, 5-2289, 5-53482, 5-61383, etc.).

The cleaning simultaneous with developing refers to collecting the untransferred toner on the photosensitive member by the toner bearing member (a toner supplying member and a developing member) of developing means by a fog removing potential difference Vback which is the potential difference between a DC voltage applied to the toner bearing member and the surface potential (unexposed portion) of the photosensitive member during the development in the next step and subsequent steps.

According to this, even if there is no cleaning device exclusively for the cleaning purpose for the photosensitive member, the untransferred toner is collected by the developing means and is used for the development in the next step and sugsequent steps and therefore, any waste toner can be eliminated. Also, it is unnecessary to provide cleaning means exclusively for the cleaning purpose discretely and therefore, a merit in terms of space is great and the apparatus can be greatly downsized.

Accordingly, even in the image forming apparatus as described in Japanese Patent Laid-Open Application No. 53-74037 wherein a plurality of photosensitive members are stacked and toner images are successively transferred to a recording material, it has been desired to adopt the cleaning simultaneous with developing system with the ecological countermeasure by the non-production of waste toner, the longer life of the photosensitive members and the curtailment of the amount of consumed toner per page taken into account.

However, when the cleaning simultaneous with developing system is adopted in such an image forming apparatus in which a plurality of photosensitive members are stacked and toner images are successively transferred to a recording material conveyed by a transfer belt, the following problem would occur to mind.

Toner images on the photosensitive members are successively transferred to a recording material while the recording material supported on the transfer belt is brought into contact with the plurality of photosensitive members in succession, but at this transferring step, so-called paper powder contained in the recording material adheres to the surfaces of the photosensitive members. Such paper powder brought about by the recording material poses no problem in an image forming apparatus having cleaning means because most of the paper powder is removed from the surface of the photosensitive member by the cleaning means, but when the cleaning simultaneous with developing system is adopted, there has been the possibility that the paper powder adheres to the surfaces of the photosensitive members and streak-like bad images are created.

SUMMARY OF THE INVENTION

It is an object of the present invention to provide an image forming apparatus which can reduce the possibility of paper powder adhering to image bearing members.

It is another object of the present invention to provide an image forming apparatus which can reduce the deterioration of the quality of formed images even if there are occasions when paper powder adheres to an image bearing member.

Further objects of the present invention will become apparent from the following detailed description when read with reference to the accompanying drawings.

DESCRIPTION OF THE PREFERRED EMBODIMENTS

Embodiment 1

Figure 1:
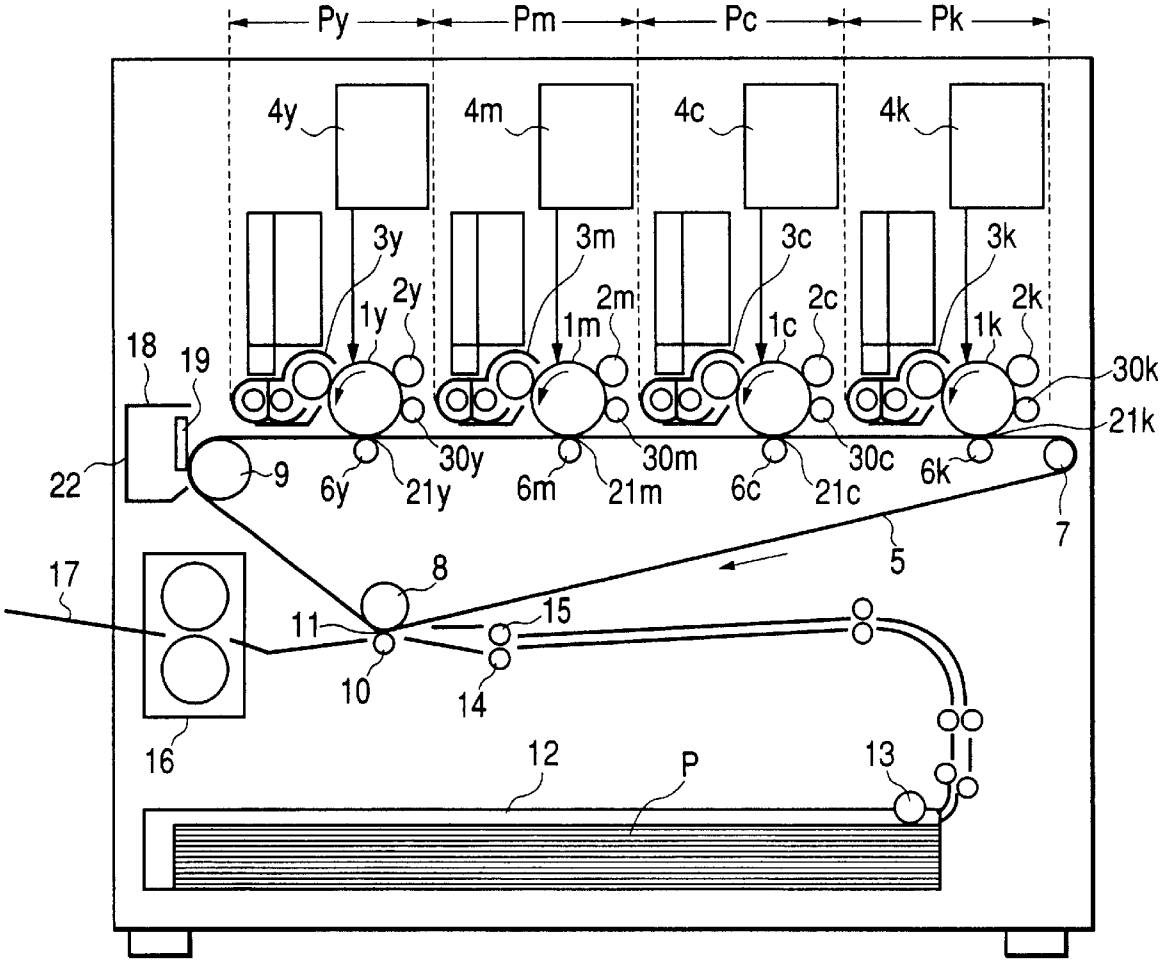
FIG. 1 is a schematic cross-sectional view of an image forming apparatus according to the present invention.

FIG. 1 is a schematic cross-sectional view showing an embodiment of the image forming apparatus of the present invention.

As shown in FIG. 1, this image forming apparatus has a plurality of image forming units Py, Pm, Pc and Pk arranged in the named order on the upper track of an intermediate transfer belt 5 along the direction of movement of the intermediate transfer belt 5.

The image forming units Py, Pm, Pc and Pk have photosensitive drums 1*y*, 1*m*, 1*c* and 1*k*, respectively, and the formation of yellow, magenta, cyan and black images of the negative charging polarity as the color separation component images of a full-color image is done. In the present embodiment, each of these photosensitive drums 1*y*, 1*m*, 1*c* and 1*k* is an OPC (organic photoconductor) photosensitive member having a diameter of 30 mm and a length of 300 mm, and is rotatively driven at a peripheral speed of 100 mm/sec. (the same as the process speed) in the counter-clockwise direction indicated by the arrow.

In the present embodiment, each of the photosensitive drums 1*y*–1*k* comprises an aluminum base and five OPC photosensitive layers formed on the surface thereof, and the OPC photosensitive layers are comprised of the following five layers successively layered.

First layer: this is an undercoat layer provided to uniform the defect of the aluminum base, and is an electrically conductive layer having a thickness of 20 $\mu$m.

Second layer: this is a positive charge blocking layer which performs the role of preventing positive charges transfused from the aluminum base from negating negative charges charged on the surface of the photosensitive member, and is an intermediate layer having a thickness of 1 $\mu$m and resistance-adjusted to the order of $10^6$ Ω·cm by amylan resin and methoxymethylated nylon.

Third layer: this is a charge generation layer having a thickness of about 0.3 $\mu$m and comprising disazo pigment dispersed in resin, and generates a pair of positive and negative charges by receiving exposure.

Fourth layer: this is a charge transport layer comprising a P-type Semoconductor comprising hydrazone dispersed in polycarbonate resin. Accordingly, negative charges charged on the surface of the photosensitive member cannot move through this layer, and only the positive charge generated in the charge generation layer can be transported to the surface of the photosensitive member.

Fifth layer: this is a charge transfusion layer which is a coating layer of a material comprising ultra-fine particles of $SnO_2$ as electrically conductive fine particles dispersed in a binder of insulative resin. Specifically, a coating liquid comprising 70% by weight of ultra-fine particles of $SnO_2$ having a particle diameter of 0.03 $\mu$m made low in resistance (electrically conductive) by doping antimony which is a light-transmitting electrically conductive filler and dispersed in insulative resin was prepared, and this was applied to a thickness of 3 $\mu$m by a suitable coating method such as a dipping coating method, a spray coating method, a roll coat coating method or a beam coat coating method to thereby form the charge transfusion layer.

Instead of such OPC photosensitive drums, photosensitive drums having a surface layer comprising amorphous silicon (amorphous silicon drums) can be used as the photosensitive drums 1*y*–1*k*. Also, the photosensitive drums 1*y*–1*k* can be made to have a low-resistance layer having surface resistance of the order of $10^9$–$10^{14}$ Ω·cm.

Around the photosensitive drums 1*y*, 1*m*, 1*c* and 1*k*, there are disposed contact chargers 2*y*, 2*m*, 2*c* and 2*k*, image exposing devices 4*y*, 4*m*, 4*c* and 4*k*, developing devices 3*y*, 3*m*, 3*c* and 3*k*, and primary transfer rollers 6*y*, 6*m*, 6*c* and 6*k*.

Figure 3:
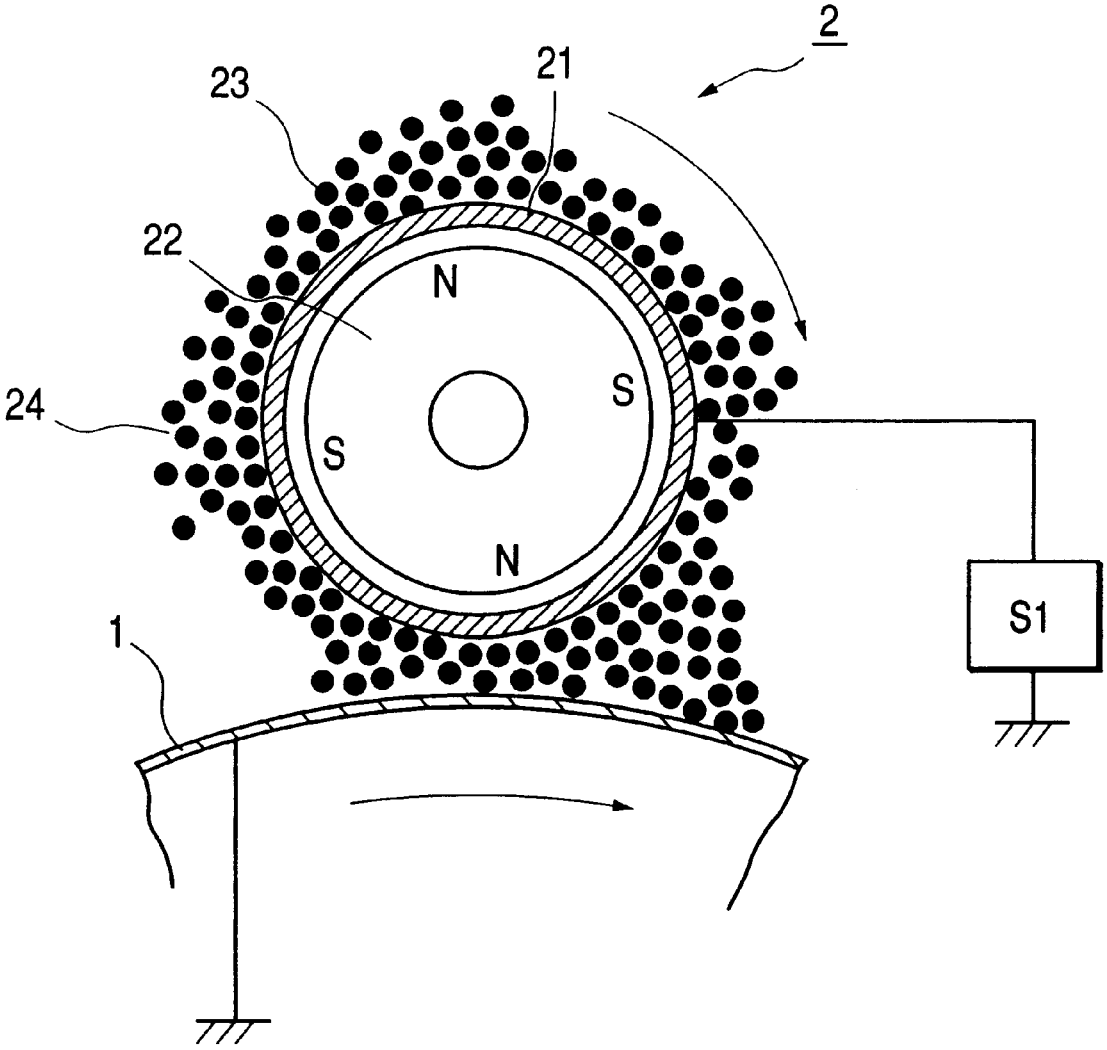
FIG. 3 is a schematic cross-sectional view of a charger.

Each of the contact chargers 2*y*–2*k*, as shown in FIG. 3, comprises a magnetic brush charging member of a sleeve rotation type. This charging member comprises a stationary magnet roller 22 of a diameter of 16 mm having each two S poles and N poles (each pole being about 100 mT), a non-magnetic sleeve 21 made of SUS rotatably fitted onto the outer side of the magnet roller 22, and a magnetic brush layer 24 of magnetic particles held on the surface of the sleeve 21 by the magnetic force of the magnet roller.

The magnetic particles 23 constituting the magnetic brush layer may preferably have an average particle diameter of 10–100 $\mu$m, saturated magnetization of 20–250 A·m$^2$/kg, and resistance of $10^2$–$10^{10}$ Ω·cm, and the resistance may desirably be $10^6$ Ωcm or greater when it is taken into account that a defect of insulation like a pinhole is present in the photosensitive drum. In the present embodiment, the measurement of the resistance value of the magnetic particles was carried out by a method of putting 2 g of magnetic particles into a metal cell having a bottom area of 228 mm$^2$, and thereafter applying a voltage of 100 V to the opposite ends of the metal cell with the metal cell weighted with 6.6 kg/cm$^2$.

To better the charging performance, the magnetic particles may preferably have the smallest possible resistance, and in the present embodiment, use was made of magnetic particles having an average particle diameter of 25 $\mu$m, saturated magnetization of 200 A·m$^2$/kg and resistance of $5\times10^6$ Ω·cm, and about 40 g of these magnetic particles were held on the surface of the sleeve by a magnetic force to thereby form a magnetic brush layer.

As the magnetic particles, use is made of a resin carrier formed by dispersing the magnet powder of a magnetic material in resin, and dispersing carbon black therein for electrical conduction and resistance adjustment, or particles obtained by coating the surface of a simplex of magnetite such as ferrite with resin, and effecting resistance adjustment.

The magnetic brush chargers 2*y*–2*k* are disposed with their magnetic brushes brought into contact with the surfaces of the respective photosensitive drums 1*y*–1*k*. The width of the contact nip portion between each magnetic brush layer and each photosensitive drum is 6 mm. A predetermined charging bias of the same polarity (negative polarity) as the normal charging polarity of the toner was applied from a charging powder source S1 to the sleeve, and the sleeve was rotatively driven in the contact nip portion with the photosensitive drum at a peripheral speed of 150 mm/sec. in a direction (clockwise direction) counter to the direction of rotation of the photosensitive drum. Thereby, the surface of the photosensitive drum is rubbed by the magnetic brush layer to which the charging bias has been applied, and charges are transfused into the photosensitive layer of the photosensitive drum, whereby the surface of the photosensitive layer is uniformly primary-charged to desired potential (negative polarity) by a transfusion charging method. In the present embodiment, the surfaces of the photosensitive drums 1*y*–1*k* were uniformly charged to nearly −700 V. Any residual toners on the photosensitive drums are frictionally charged to the negative polarity by the magnetic brush layer and are discharged onto the photosensitive drums. The charged residual toners are electrostatically collected into the developing devices by a desired voltage (developing bias (negative polarity)) being applied to the developing sleeves of the developing devices 3*y*–3*k*. Also, it is preferable to once charge the residual toners on the photosensitive drums to the positive polarity by discretely provided chargers 30*y*–30*k*, and then introduce them to the magnetic brush charging members and charge them. The plurality of second charging means 30*y*, 30*m*, 30*c*, and 30*k* for charging the residual toners on the image bearing members to a polarity opposite to the normal charging polarity of the toners before the residual toners on the image bearing members are charged by the charging means.

As described above, the magnetic brush chargers are adopted in the present embodiment, and the reason for this is that the magnetic brush charging method has numerous merits as compared with the other charging methods. The merits of the magnetic brush chargers will hereinafter be described while being compared with the corona charging method and the roller charging method generally used as the other charging methods.

Firstly, when the magnetic brush charging method is used, the transfusion charging method can be easily adopted as described above and as the result, the production of ozone can be substantially eliminated. Regarding the point of the production of ozone, the corona charging method is disadvantageous, and the roller charging method is improved in this point as compared with the corona charging method, but it has not yet reached the level of eliminating the production of ozone.

Secondly, when the magnetic brush charging method is used, there is the merit that the cleanerless system can be easily adopted. In the cleanerless system, it is necessary to collect untransferred toners by the developing devices, but usually the untransferred toners in their intact state are insufficient particularly in an electrical characteristic such as triboelectricity for the collection into the developing devices and therefore, the collection of the untransferred toners is not effected well. Therefore, prior to the collection into the developing devices, some pre-processing to the untransferred toners becomes necessary, but in the magnetic brush charging method, the magnetic brushes are in direct contact with the photosensitive drums and in these portions of contact, the untransferred toners are once collected into the charging magnetic brushes and there, the toners can be charged (to the negative polarity) so that they may be easily collected by the developing devices and therefore, the collecting operation for the untransferred toners in the developing devices is performed well and the cleanerless system is easily achieved.

As described above, the untransferred toners on the photosensitive drums can be introduced into the magnetic brush chargers and be charged to the desired negative polarity by the frictional charging with the magnetic brushes and also, those portions of the surfaces of the photosensitive drums on which the untransferred toners were present before charging can be charged well by the magnetic brush chargers and therefore, simultaneously with developing, the collection of the untransferred toners, i.e., the cleaning, can be effected.

On the other hand, in the corona charging method, the charging members are in non-contact with the photosensitive drums and therefore, the improvement in the quality of the untransferred toners by the charging members as described above cannot be done.

In the roller charging method, the charging members themselves are in contact with the photosensitive drums and therefore, it is possible for the charging members to affect the untransferred toners, but as in the magnetic brush chargers, the untransferred toners cannot be introduced into the magnetic brushes thereof and be improved in their chargeability, and the photosensitive drums cannot be charged well and therefore, a sufficient effect cannot be displayed, either.

The image exposing devices 4*y*–4*k* used are LED arrays as solid state scanners which do not require an optical path length and are advantageous for the downsizing of the apparatus. The individual LED's of the LED arrays 4*y*–4*k* are controlled to flicker (ON/OFF-controlled) correspondingly to the time-series electrical digital pixel signal of original image information inputted from an image reading apparatus, not shown, whereby image exposure is done on the surfaces of the uniformly charged photosensitive drums 1*y*–1*k*, and the surface potential of the exposed portions of the photosensitive drums 1*y*–1*k* is attenuated and electrostatic latent images are formed.

In the present embodiment, each of the developing devices 3*y*–3*k* as developing means comprises a two-component magnetic brush developing device. Each of the developing devices 3*y*–3*k* is provided with a developer container containing therein a two-component developer comprising a non-magnetic toner and a magnetic carrier mixed with each other, a development sleeve, a magnet roller fixedly disposed in the development sleeve, a regulating blade for applying a thin layer of developer to the surface of the development sleeve, etc.

The developing device 3*y* in the yellow image forming unit Py contains therein a two-component developer containing a yellow toner, and a developing bias (the negative polarity) is applied to the development sleeve, whereby an electrostatic latent image corresponding to a yellow image formed on the surface of the photosensitive drum 1*y* is reversal-developed and is visualized as a yellow toner image. This also applies to the developing devices 3*m*, 3*c* and 3*k* in the other color image forming units Pm, Pc and Pk, respectively, and respective electrostatic latent images are reversal-developed by a similar method and are visualized as magenta, cyan and black toner images.

The intermediate transfer belt 5 is an endless belt as an intermediate transfer member, and is passed over three rollers, i.e., a driving roller 7, a secondary transfer opposed roller 8 and a driven roller 9. This intermediate transfer belt 5 is disposed over the image forming units Py–Pk in such a manner as to contact with the lower surfaces of the photosensitive drums 1*y*–1*k*, and is rotatively driven in the clockwise direction indicated by the arrow substantially at the same peripheral speed as the photosensitive drums 1*y*–1*k*.

Primary transfer rollers 6*y*–6*k* are disposed inside the belt portion of the upper track of the intermediate transfer belt 5 in opposed relationship with the respective photosensitive drums 1*y*–1*k*. The primary transfer roller 6*y* of the yellow image forming unit Py bears against the lower surface of the photosensitive drum 1*y* with the intermediate transfer belt 5 interposed therebetween, and forms a primary transfer portion 21*y*. Likewise, the primary transfer rollers 6*m*, 6*c* and 6*k* of the magenta, cyan and black image forming units Pm, Pc and Pk bear against the lower surfaces of the photosensitive drums 1*m*, 1*c* and 1*k*, respectively, with the intermediate transfer belt 5 interposed therebetween, and form primary transfer portions 21*m*, 21*c* and 21*k*.

A transfer bias opposite in polarity to the toners is applied from a primary transfer power source, not shown, to each of the primary transfer rollers 6*y*–6*k*, and by the application of this transfer bias, the toner images on the photosensitive drums 1*y*–1*k* are electrostatically primary-transferred to the surface of the intermediate transfer belt 5 in the respective primary transfer portions 21*y*–21*k* in superposed relationship with one another. Thereby, a full-color image comprising yellow, magenta, cyan and black toner images superposed one upon another and combined together is formed on the intermediate transfer belt 5.

According to the present invention, the image forming apparatus adopts the cleaning simultaneous with developing system and is made into a cleanerless system, and the developing devices 3*y*–3*k* serve also as cleaning means for removing untransferred toners residual after the toner images on the respective photosensitive drums 1*y*–1*k* have been transferred. Accordingly, the image forming units Py–Pk are not provided with cleaning devices exclusively for the photosensitive drums 1*y*–1*k*. However, development need not be effected simultaneously with cleaning. However, if cleaning is effected simultaneously with development, when images are to be continuously formed on a plurality of recording materials, the throughput of image formation can be improved.

At the place of the secondary transfer opposed roller 8 of the intermediate transfer belt 5, a secondary transfer roller 10 contacting therewith with the intermediate transfer belt 5 interposed therebetween and forming a secondary transfer portion 11 is disposed. The full color image formed on the intermediate transfer belt 5 comes to the secondary transfer portion 11 with the rotation of the intermediate transfer belt 5, and a transfer bias opposite in polarity to the toners is applied from a secondary transfer power source, not shown, to the secondary transfer roller 10, whereby the full color image is collectively secondary-transferred to the surface of a recording material (recording paper) P supplied to the secondary transfer portion.

The recording material P is contained in a sheet feeding cassette 12 installed in the lower portion of the image forming apparatus. The recording material P in the cassette 12 is taken out and conveyed by a sheet feeding roller 13, and is once stopped by a pair of registration rollers 14 and 15 short of the secondary transfer portion 11, whereafter the recording material P is supplied to the secondary transfer portion 11 in timed relationship with the arrival of the leading end of the image on the intermediate transfer belt 5 at the secondary transfer portion 11.

The recording material P to which the full-color image has been transferred in the secondary transfer portion 11 is separated from the surface of the intermediate transfer belt 5 and is introduced into a fixing device 16, where it is subjected to the thermal fixation of the image and the transferred image is made into a permanent image of full color, and the recording material P is discharged onto a tray 17 outside the apparatus.

After the secondary transfer is finished, from the intermediate transfer belt 5, untransferred toners residual on its surface after the secondary transfer and paper powder adhering thereto from the recording material P are removed by a belt cleaning device 18 installed at the place of the driven roller 9. The belt cleaning device 18 is provided with a plate-shaped rubber blade (cleaning blade) 19, and this blade 19 is brought into pressure contact (counter contact) with the driven roller 9 with the intermediate transfer belt 5 interposed therebetween to thereby form a cleaning portion. The pressure contact of the cleaning blade 19 with the intermediate transfer belt 5 may be done by the utilization of the elasticity of the blade 19 itself, and preferably may be done by the provision of a pressing mechanism such as a spring, and if this is done, stable contact pressure can be secured even during long-term use.

In the present invention, the image forming apparatus is adapted to form a full-color image on the intermediate transfer belt 5 while the intermediate transfer belt 5 makes one full rotation by the use of a plurality of photosensitive drums. Accordingly, in the case of an image forming apparatus in which an intermediate transfer member is caused to make a plurality of full rotations by the use of a photosensitive drum to thereby form a full color image, a cleaning device for the intermediate transfer member has required its movement to contact with and separate from the intermediate transfer member, while in the present invention, the movement of the belt cleaning device 18 to contact with and separate from the intermediate transfer belt 5 is unnecessary, and the cleaning blade 19 can be kept in contact with the intermediate transfer belt 5 at least until the image formation on the recording material is completed, and therefore the cleaning device has high cleaning performance for the surface of the intermediate transfer belt 5.

The intermediate transfer belt 5 may use as its belt material a material comprising electrically conductive carbon particles, metal powder or the like dispersed in and mixed with, for example, polyurethane resin, polyester resin, polyethylene resin, polyolefin resin, polyamide resin, polyimide resin, polyvinyl chloride resin, fluorine resin or the like.

In the present embodiment, a material comprising carbon particles dispersed in polyimide resin is used for the intermediate transfer belt 5. The volume resistivity of this material may preferably be within the range of $10^6$–$10^{14}$ Ω·cm. When the volume resistivity of the intermediate transfer belt 5 is less than $10^6$ Ω·cm, there arises the problem that blur and thickening occur to images and transfer efficiency changes during the formation of images differing in image proportion, and on the other hand, in the case of an intermediate transfer belt 5 of which the volume resistivity is greater than $10^{14}$ Ω·cm, the abnormal discharge between the intermediate transfer belt 5 and each of the photosensitive drums 1*y*–1*k* or the recording material P due to the potential of the intermediate transfer belt 5 becoming too great during transfer occurs and bad images occur. In the present embodiment, a seamless belt having a thickness of 100 μm and volume resistivity of $10^{11}$ Ω·cm is used as the intermediate transfer belt 5.

The belt cleaning device 18 is provided with a cleaning blade 19 which is a plate-shaped rubber blade, as previously described, and is further comprised of a container 22 for containing waste toner and paper powder, or a conveying screw or the like for transporting waste toner and paper powder to a waste toner container of a large capacity provided at another place. As the cleaning blade 19, use is made of polyurethane rubber, and more particularly, use is made of rubber in which, of the physical properties of this rubber, the tensile stress (JIS K6301) during 5% stretch is 80–120 kg/cm$^2$. The tensile stress was measured by cutting out a rubber plate forming the cleaning blade into the shape of a dumbbell and pulling the opposite ends thereof.

If the tensile stress of the rubber of the cleaning blade 19 is less than 80 kg/cm$^2$, even if the pressing force of the blade 19 against the intermediate transfer belt 5 is made great, the pressure obtained as a peak value does not become considerably great, and if an attempt is made so that sufficient cleaning performance for the untransferred toner and paper powder on the intermediate transfer belt 5 may be obtained, the necessity of applying excessively great pressure arises, and the lives of the blade 19 and the intermediate transfer belt 5 shorten and the turning-up of the blade 19 occurs. When the tensile stress of the rubber of the blade 19 is greater than 120 kg/cm$^2$, the impact resilience thereof becomes great at the same time, whereby the vibration in the portion of contact of the blade 19 with the intermediate transfer belt 5 becomes great, and bad cleaning and the turning-up of the blade become liable to occur. Also, the permanent strain of the blade tends to become great and therefore, a problem also arises in terms of durability.

If there is the adherence of paper powder to the surfaces of the photosensitive drums, the paper powder becomes low in resistance particularly under high-humidity environment and reduces the potential holding capability of the surfaces of the photosensitive drums to thereby cause a smeared image in which the latent image becomes blurred and therefore, there has heretofore been the possibility of a bad image being created, but according to the present embodiment, this can be prevented.

In the present invention, as previously described, the image forming apparatus is adapted to form a full color image on the intermediate transfer belt 5 while the intermediate transfer belt 5 makes one full rotation by the use of the plurality of photosensitive drums and therefore, the belt cleaning device 18 need not perform the movement toward and away from the intermediate transfer belt 5 as when the intermediate transfer member is caused to make a plurality of full rotations by the use of a photosensitive drum to thereby form a full-color image, and the cleaning blade 19 can always be kept in contact with the intermediate transfer belt 5 and can therefore well remove any paper powder having adhered to the surface of the intermediate transfer belt 5 during the secondary transfer, and it has become possible to reduce the shift of the paper powder to the photosensitive drums 1*y*–1*k*.

As described above, it has become possible to reduce the shift of the paper powder to the photosensitive drums 1*y*–1*k* and therefore, the mixing of the paper powder with the magnetic brush chargers 2*y*–2*k* can be greatly decreased, and it has become possible to prevent a streak-like bad image created by a general reduction in chargeability, and above all, a partial direction in chargeability.

Further, it has also become possible at the same time to prevent bad development, and particularly a streak-like bad image by the paper powder mixing with the developing devices 3*y*–3*k* and reducing developability.

Also, if the paper powder cannot be completely removed from the intermediate transfer belt 5 by the cleaning by the belt cleaning device 18 and remains on the belt 5 and the paper powder is introduced and adheres to the photosensitive drums, more or less smeared image will occur, but the image forming unit Py for forming an image by the yellow developer is the first unit, and this yellow image is low in visibility as compared with the other magenta, cyan and black images and is inconspicuous even if it has more or less defect and therefore, the color image outputted from the image forming apparatus can be made free of a problem in practical use.

This is because most of the paper powder which could not be completely removed and remains on the intermediate transfer belt 5 adheres to the photosensitive drum provided most upstream with respect to the direction of movement of the intermediate transfer belt 5, i.e., the photosensitive drum 1*y*.

In the foregoing, an image forming apparatus for obtaining a color image comprising four colors, i.e., yellow, magenta, cyan and black, superposed one upon another has been taken up as an example and therefore, the image forming unit disposed at the first position after secondary transfer is the unit Py for the yellow image lowest in visibility of the above-mentioned four colors, but in an image forming apparatus using a combination of other colors, an image forming unit for a color lowest in visibility of the combination can be disposed at the first position after secondary transfer, and a similar effect is obtained.

Embodiment 2

Figure 2:
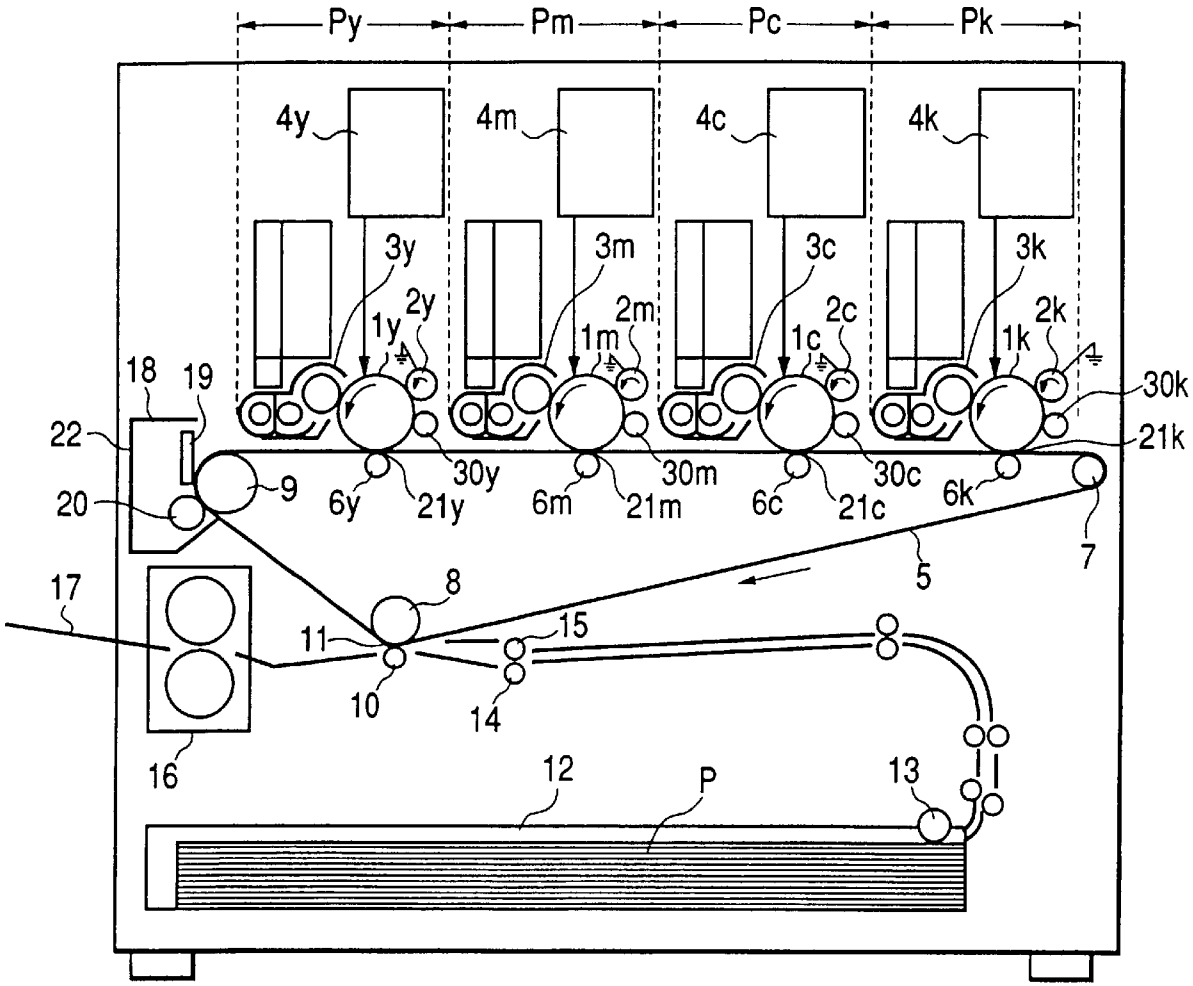
FIG. 2 is a schematic cross-sectional view of an image forming apparatus according to the present invention.

FIG. 2 schematically shows the construction of another embodiment of the image forming apparatus of the present invention.

This embodiment is characterized in that in Embodiment 1 described with reference to FIG. 1, the belt cleaning device 18 is provided with a fur brush 20 as a paper powder removing member, besides the cleaning blade 19. In the other points, the construction of the present embodiment is basically the same as that of Embodiment 1, and in FIG. 2, the same reference characters designate the same members.

As shown in FIG. 2, the fur brush 20 of the belt cleaning device 18 is rotatably installed at a location upstream of the cleaning blade 19 with respect to the direction of movement of the intermediate transfer belt 5, and abuts against the surface of the intermediate transfer belt 5. This fur brush 20 can not only remove the paper powder on the surface of the intermediate transfer belt 5, but also can remove the charges of the intermediate transfer belt 5 and the untransferred toner on the surface thereof by being made electrically conductive and grounded. By this removal of the charges, the cleaning of the untransferred toner on the intermediate transfer belt 5 by the cleaning blade 19 becomes easy.

The fur brush 20 can provide a good result if it comprises electrically conductive threads having a thickness of 3–10 deniers (D) (e.g. carbon dispersed in rayon resin and formed into fibers) and implanted so that the density thereof may become 50,000–200,000 lines/inch$^2$, and having a staple length of 3–10 mm and an amount of entry of the order of 0.2–2.5 mm, and in the present embodiment, the fur brush 20 is such that the thickness of the threads is 6 deniers, the implant density is 100,000 lines/inch$^2$, the staple length is 5 mm and the amount of entry is 0.5 mm.

When image formation was done by the use of the image forming apparatus of the above-described construction according to the present embodiment, an effect equal to or greater than the effect of Embodiment 1 was obtained.

That is, in the present embodiment, the belt cleaning device 18 always abutting against the intermediate transfer belt 5 is provided with not only the cleaning blade 19, but also the fur brush 20 suited for the removal of paper powder and rotated in a counter direction at the abutting position and therefore, the paper powder on the surface of the intermediate transfer belt 5 can be better removed to thereby further improve the prevention of the shift of the paper powder to the photosensitive drums and as the result, the mixing of the paper powder with the magnetic brush chargers 2*y*–2*k* can be greatly decreased, and it has become possible to more reliably prevent streak-like bad images created by a general reduction in chargeability, and above all, a partial reduction in chargeability.

Also, bad images, particularly streak-like bad images, created by paper powder mixing with the developing devices 3*y*–3*k* to thereby reduce developability can be prevented more effectively.

In the foregoing, the grounded electrically conductive fur brush 20 is used as a paper powder removing member, but in the present invention, the paper powder removing member is not restricted thereto. For example, an electrically conductive fur brush, if likewise used, is not directly grounded, but can be grounded through a resistance element having a predetermined resistance value, or a varistor (a constant voltage element). Also, instead of the electrically conductive fur brush, an electrically conductive roller of $10^6$ Ω or less or a magnetic brush member comprising an electrically conductive magnetic member carried on a sleeve containing a magnet therein can also be used to obtain a similar effect.

What is claimed is:

1. An image forming apparatus comprising:

a plurality of image bearing members;

a plurality of developing means for developing latent images formed on said plurality of image bearing members with toners of plural colors;

an endless intermediate transfer member to which toner images of plural colors are successively transferred from said plurality of image bearing members, the toner images of plural colors on said intermediate transfer member being transferred to a recording material; and a plurality of charging means for charging residual toners residual on said image bearing members after the toner images have been transferred from said image bearing members to said intermediate transfer member, wherein the residual toners on said image bearing members charged respectively by said charging means being electrostatically collected into said developing means respectively, and wherein a toner image of a color lowest in visibility is formed on one of said plurality of image bearing members on which a toner image is first formed.

2. An image forming apparatus according to claim 1, wherein said charging means are provided with magnetic particles for frictionally charging the residual toners on said image bearing members to a same polarity as a normal charging polarity of the toners.

3. An image forming apparatus according to claim 2, wherein said charging means are provided with a plurality of rotary members retaining said magnetic particles by a magnetic force.

4. An image forming apparatus according to claim 3, wherein at a position whereat each of said charging means and each of said image bearing members contact with each other, a direction of movement of each of said image bearing members and a direction of movement of each of said rotary members differ from each other.

5. An image forming apparatus according to claim 1, wherein said charging means charge the residual toners on said image bearing members and at a same time, charge surfaces of said image bearing members to form latent images on said image bearing members.

6. An image forming apparatus according to claim 5, further comprising a plurality of second charging means for charging the residual toners on said image bearing members to a polarity opposite to the normal charging polarity of the toners before the residual toners on said image bearing members are charged by said charging means.

7. An image forming apparatus according to claim 5, wherein at each developing position by each of said developing means, the residual toner on each of said image bearing members charged by each of said charging means is electrostatically collected into each of said developing means and at a same time, there is formed an electric field for the latent image formed on each of said image bearing members to be electrostatically developed with the toner by each of said developing means.

8. An image forming apparatus according to claim 5, further comprising a plurality of exposing means for exposing the surfaces of said image bearing members based on image information to form latent images on the surfaces of said image bearing members charged by said charging means.

9. An image forming apparatus according to claim 5, wherein said charging means charge said image bearing members to the same polarity as a normal charging polarity of the toners.

10. An image forming apparatus according to claim 1, further comprising cleaning means provided with a blade contacting with said intermediate transfer member, and for cleaning said intermediate transfer member.

11. An image forming apparatus according to claim 10, wherein the recording material is recording paper, and said cleaning means removes paper powder adhering to said intermediate transfer member.

12. An image forming apparatus according to claim 10, wherein said cleaning means is provided with a rotatable brush adapted to contact with said intermediate transfer member before said intermediate transfer member is cleaned by said blade.

13. An image forming apparatus according to claim 12, wherein said brush is electrically grounded.

14. An image forming apparatus according to claim 13, wherein at a position whereat said intermediate transfer member and said brush contact with each other, a direction of movement of said intermediate transfer member differs from a direction of movement of said brush.

15. An image forming apparatus according to any one of claims 1–14, wherein the toner image of the color lowest in visibility is a yellow toner image.

16. An image forming apparatus according to claim 15, wherein the yellow toner image, a magenta toner image, a cyan toner image and a black toner image are formed on said plurality of image bearing members.

* * * * *

UNITED STATES PATENT AND TRADEMARK OFFICE

CERTIFICATE OF CORRECTION

PATENT NO. : 6,438,343 B1
DATED : August 20, 2002
INVENTOR(S) : Masahiro Inoue

It is certified that error appears in the above-identified patent and that said Letters Patent is hereby corrected as shown below:

Title page,
Item [57], ABSTRACT,
Line 10, “toners residual” should read -- toners --.

Column 1,
Line 56, “sugsequent” should read -- subsequent --.

Column 2,
Line 10, “occur” should read -- come --.

Column 3,
Line 10, “uniform” should read -- make uniform --.
Line 26, “Semoconductor” should read -- Semiconductor --.

Column 4,
Line 33, “powder” should read -- power --.

Column 7,
Line 6, “with” should be deleted.
Line 61, “with” should be deleted.
Line 63, “with” should be deleted.

Column 8,
Line 55, “become” should read -- are --.

Column 11,
Line 27, “with” should be deleted.

UNITED STATES PATENT AND TRADEMARK OFFICE

CERTIFICATE OF CORRECTION

PATENT NO. : 6,438,343 B1
DATED : August 20, 2002
INVENTOR(S) : Masahiro Inoue

It is certified that error appears in the above-identified patent and that said Letters Patent is hereby corrected as shown below:

Column 12,
Line 18, "with" should be deleted.
Line 26, "with" should be deleted.
Line 33, "with" should be deleted.

Signed and Sealed this

Thirty-first Day of December, 2002

JAMES E. ROGAN
*Director of the United States Patent and Trademark Office*